US005949313A

United States Patent [19]

Aoki et al.

[11] Patent Number: 5,949,313

[45] **Date of Patent: *Sep. 7, 1999**

[54] ELECTROMAGNETIC RELAY FOR LOW ACOUSTIC NOISE

[75] Inventors: Shigemitsu Aoki, Suzaki; Hiroyuki Uchino, Kawasaki; Yoshio Okamoto, Suzaka, all of Japan

[73] Assignee: Fujitsu Takamisawa Component Limited, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/890,447

[22] Filed: Jul. 9, 1997

[30] Foreign Application Priority Data

Jul. 11, 1996 [JP] Japan ..... 8-182057

[51] Int. Cl.[6] ..... H01H 51/22

[52] U.S. Cl. ..... 335/78; 335/90; 335/133

[58] Field of Search ..... 335/78–86, 124, 335/128, 90, 104, 105, 133; 361/728, 742, 744

[56] References Cited

U.S. PATENT DOCUMENTS 4,761,627 8/1988 Bell ..... 335/80

4,873,615 10/1989 Grabbe ..... 361/395

5,216,397 6/1993 Matsuoka et al. ..... 335/78

5,694,099 12/1997 Connell et al. ..... 335/128

*Primary Examiner*—Lincoln Donovan

*Attorney, Agent, or Firm*—Staas & Halsey, LLP

[57] ABSTRACT

An electromagnetic relay for low acoustic noise in operation including a body having an insulating inner base, an electromagnet having an iron core, a moving spring contact having an armature, and a fixed spring contact for making an on/off action between the moving and fixed spring contacts by actuating the electromagnet, wherein the insulating inner base supports other members of the body, a plurality of L shaped conducting suspenders suspend the insulating inner base by each vertical arm, a plurality of U shaped blade springs support each horizontal arm of the L shaped conducting suspenders, and an insulating outer base having a plurality of outer terminal leads, each of which is gaplessly continuous to the corresponding one of the U shaped blade springs, support the body above the insulating outer base by each of the outer terminal leads, the U shaped blade springs, and the L shaped conducting suspenders in series connection.

20 Claims, 5 Drawing Sheets

ELECTROMAGNETIC RELAY FOR LOW ACOUSTIC NOISE

BACKGROUND OF THE INVENTION

1. Field of the Invention

This invention relates to an electromagnetic relay, particularly to one having a moving contact for a low acoustic noise in operation for use in such as automobile, audio-system, or personal computers.

2. Description of the Related Art

With a recent increase in usage of an electromagnetic relay in many fields such as automobile, audio-system, or personal computers, it has been desired to decrease acoustic noise in the operation of an electromagnetic relay having a moving contact, particularly for use in such a place that a quiet environment is required. Thus, the need for a so-called silent relay has been increased. The acoustic noise is caused by impact sounds which are originally emitted when an iron core impacts an armature, and also a moving contact impacts a fixed contact. These sounds are propagated to the outside by air confined by an outer encapsulation and mechanical components of the relay. Several attempts have been made to prevent the impact sounds from coming out. FIG. 1 is a schematic cross sectional view of the first conventional low noise relay, in which a body of an electromagnetic relay 1 is enclosed by an air-tight double container consisting of an inner and outer containers 12, 11. The inner container 12 is separated by a buffer material 14 like sponge from the outer container 11. An inner terminal lead 13 penetrating a wall of the inner container 12 is connected to an outer terminal lead 15 also penetrating a wall of the outer container 11 by a flexible mesh wire 16. Therefore, an impact sound can be absorbed by the air-tight double container and a mechanical vibration can be damped by the buffer material and the flexible mesh wire. FIG. 2 is a perspective bottom view of a second conventional low noise relay, in which a body 2 of the electromagnetic relay is suspended by an inner base 21 arranged at a top of the body 2 with three folded terminal leads 22, 23, 24. Further, the folded terminal lead 22 and a moving contact spring 26 are fixed to a side wall of an electromagnet 27. The moving contact spring 26 having an armature 25 on the fixed end is arranged at a bottom of the body together with the armature 25, while a free end of the moving contact spring 26 vibrates between a pair of fixed contact springs 28, 29. Although a part of an operating sound is admitted to be emitted to the outside through an outer encapsulation (not shown), terminal leads 22, 23, and 24 can damp the vibration during propagation. FIG. 3 is an explosive view of the third conventional low noise relay, in which a buffer 41 is arranged between a body 3 of the electromagnetic relay and an outer base 4. The buffer comprises blade springs 43 having terminal leads 44 and insulating plate 42, which are unified by insert mold technique. The body 3 has an electromagnet 33 on an inner base 31 such that an axis of coil 32 is parallel to the outer base 4. The armature 34 is opposite to the electromagnet 33 by a moving contact spring 35. Further, a pair of parallel contact springs 36, 37 are fixed to the inner base 31 between which a free end of the moving contact spring 35 is arranged such that the free end of the moving contact spring 35 vibrates in parallel to the outer base 4 together with the armature 34 driven by the activated coil 32. Each of the electric lines connecting with the coil 32, a moving contact spring 35, and a pair of parallel contact springs 36, 37 are coupled with the corresponding inner terminal 38 which is not directly extended to the outside, but, instead, is connected with the corresponding blade spring 43 arranged around the periphery of the buffer 41, from which each of the terminal lead 44 is extended outside the outer base. Similarly as before, the impact noise can be decreased by absorbing the vibrational energy into the buffer 41. However, the first conventional low noise relay can not avoid elevating a temperature of the enclosed body due to heat generated by the activated coil and switching contacts during operation. Further, a complex structure of the double container prevents miniaturization and manufacturability of the relay, both of which are rather constant requirements for an advanced relay. The second conventional low noise relay has the armature and the moving contact spring which both vibrate in the direction parallel to the terminal leads suspending the body. Therefore, the vibrational energy propagates in the terminal leads by a longitudinal mode which can not be damped efficiently. The third conventional low noise relay has the armature and the moving contact spring which both vibrate in the direction parallel to the buffer 41, but the blade spring 43 has such a short length between a fixed point and a force-acting point that a vibrational energy can not be damped much against expectation. Consequently, any of the conventional low noise relays can not fully satisfy the requirements for use in a quiet environment.

SUMMARY OF THE INVENTION

An object of the present invention is to provide an electromagnetic relay for a low acoustic noise in operation having a structure in which a body is suspended above an outer base by a conducting part which is supported by a conducting elastic part connecting to an outer terminal lead fixed to the outer base. Both the conducting part and conducting elastic part have good electric conductivity to make an electric path between the outer terminal lead and the body. Both in combination suspend the body, propagate the mechanical vibration of the body, and damp the vibrational energy. Therefore, the conducting elastic part may be composed of two materials, one has elasticity and another has electric conductivity.

BRIEF DESCRIPTION OF THE DRAWINGS

The present invention will be more apparent from the following description, when taken to conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
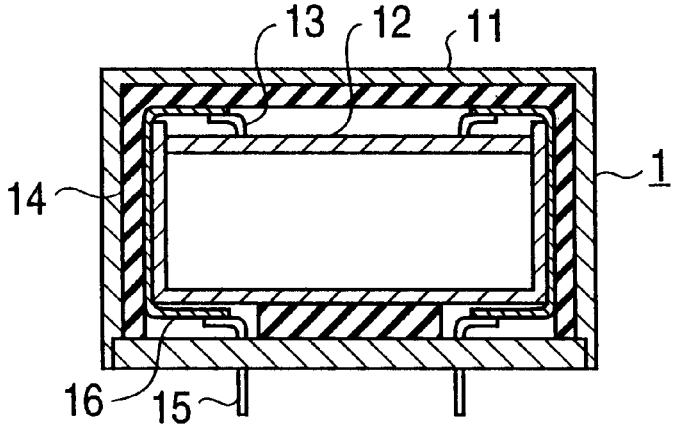
FIG. 1 PRIOR ART
FIG. 1 is a schematic cross sectional view of the first conventional electromagnetic low noise relay.
Figure 2:
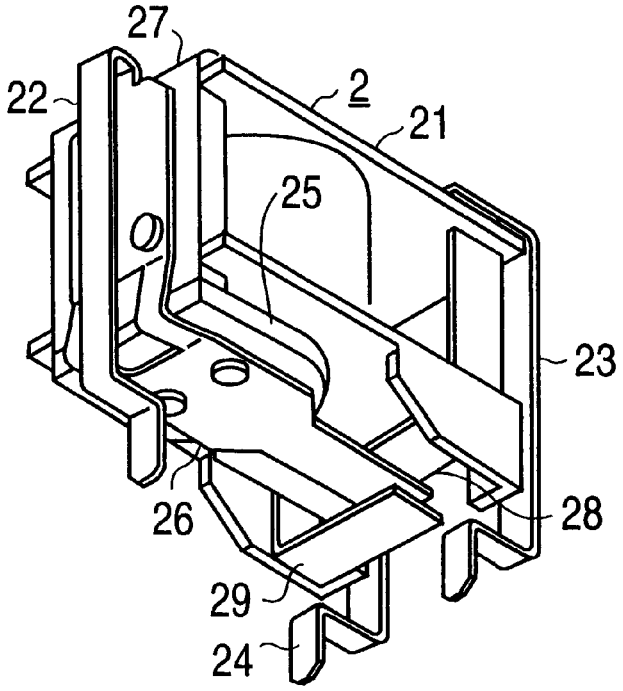
FIG. 2 PRIOR ART
FIG. 2 is a perspective bottom view of the second conventional electromagnetic low noise relay.
Figure 3:
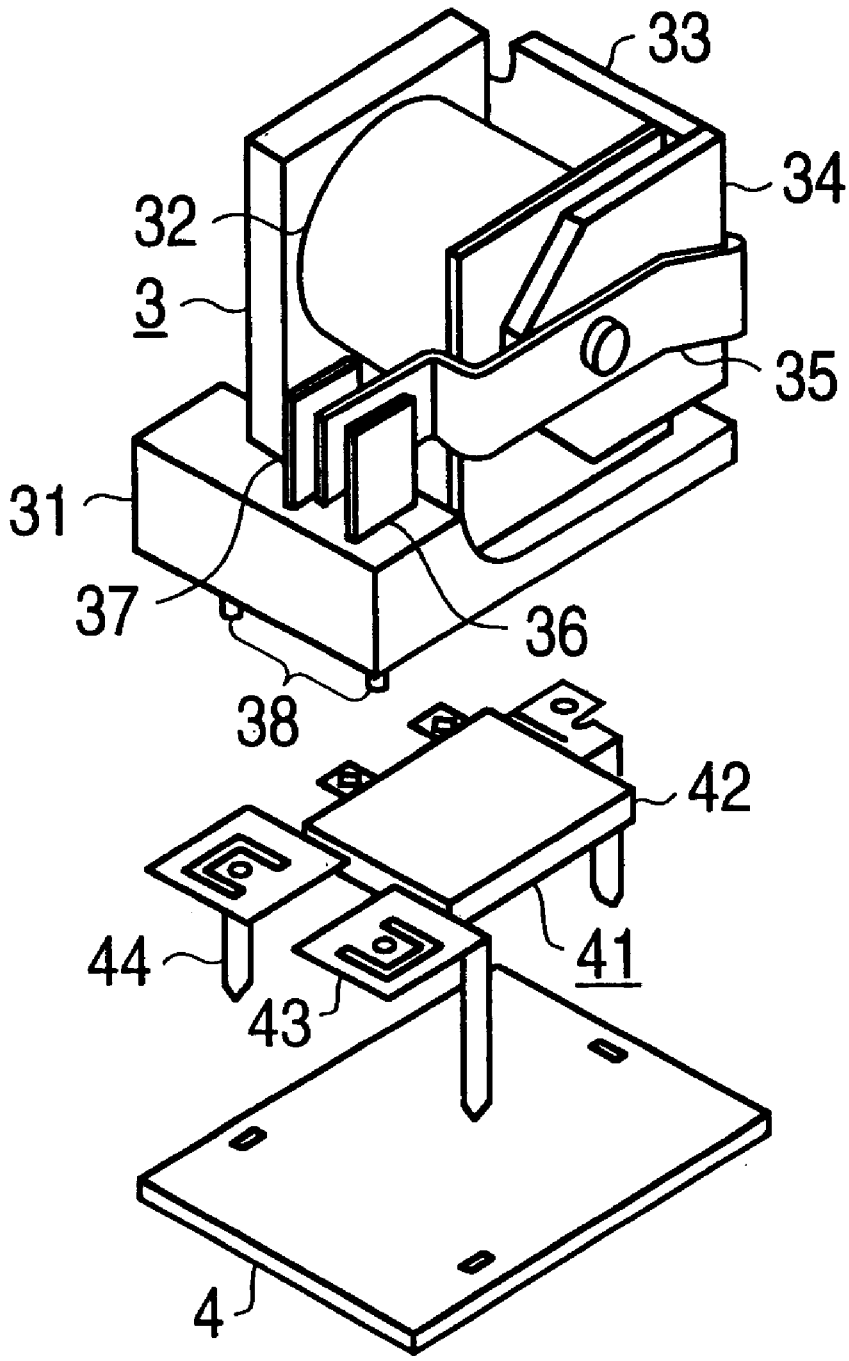
FIG. 3 PRIOR ART
FIG. 3 is an explosive view of the third conventional electromagnetic low noise relay.
Figure 4:
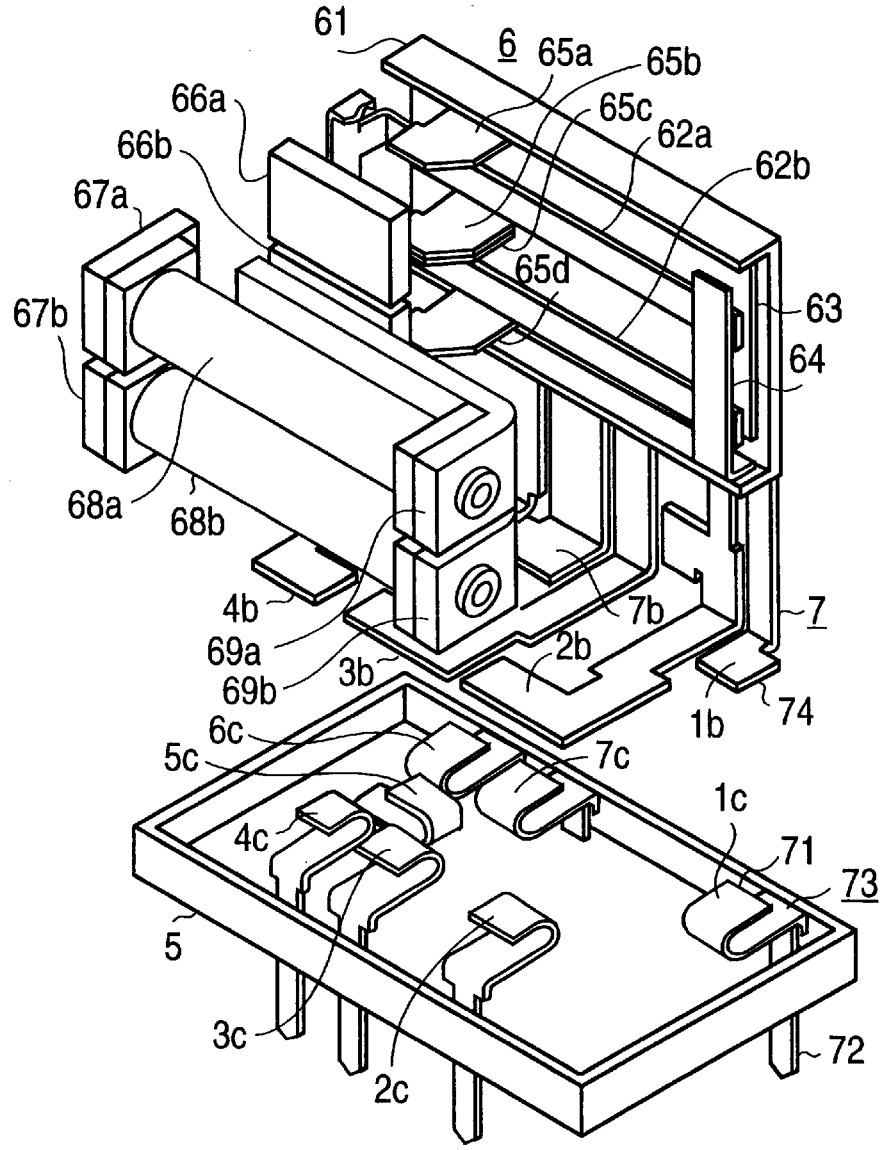
FIG. 4 is an explosive view of an electromagnetic low noise relay according to the present invention.

FIG. 4 is an explosive view of an electromagnetic low noise relay according to the present invention. The electromagnetic relay comprises an outer base 5, a body 6 of the electromagnetic relay, and a supporting part 7 secured on the outer base 5 for supporting the body 6 of the electromagnetic relay. The body 6 of the electromagnetic relay has an inner base 61, a pair of parallel moving contact springs 62*a*, 62*b* fixed to the inner base 61 at each of the fixed ends, a pair of parallel fixed contact springs 63, 64 arranged on the inner base 61 between which each of the free ends of the parallel moving contact springs 62*a*, 62*b* is positioned and that are perpendicular to each other to form a pair of cross bar switches, and an armature 66*a*, 66*b* arranged on each of the fixed ends of the parallel moving contact springs 62*a*, 62*b*, a pair of electromagnets 67*a*, 67*b* having a pair of parallel coils 68*a*, 68*b*, each of which drives the corresponding armature 67*a*, 67*b*, fixed on each of the parallel moving contact springs 62*a*, 62*b* by activating the coil 68*a*, 68*b*. The supporting part 7 comprises a plurality of L-shaped suspenders 74 and outer terminals 73 secured to the outer base 5. Each of the outer terminals 73 has a U-shaped spring 71 and an outer terminal lead 72 gaplessly continuous to the U-shaped spring 71. Each of the L-shaped suspenders 74 is supported on the outer base 5 by coupling with the U-shaped spring 71 at the lower end, and that the vertical arm of the L-shaped suspender 74 suspends the inner base 61 in perpendicular to the outer base 5, in which the body 6 is mechanically coupled with the inner base 61. All of the moving contact springs 62*a*, 62*b*, the fixed contact springs 63, 64 and the coils 68*a*, 68*b* are electrically coupled with the respective outer terminals 73 through the L-shaped suspender 74 connected in series between them. As shown in FIG. 4, since the inner base 61 of the body 6 is suspended in perpendicular to the outer base 5 by the L-shaped suspenders 74, both the armature 66*a*, 66*b* and moving contact springs 62*a*, 62*b* vibrate in parallel to the outer base 5 and resultantly the L-shaped suspenders 74 suspending the inner base 61 are accelerated horizontally. Further, most of the U-shaped springs 71 are aligned to the direction of the vibration such that the horizontal displacement is transformed into a vertical one by changing a radius of curvature of the U-shaped spring. The U-shaped spring has such elasticity and a long effective length such that the vibration can be absorbed sufficiently. The material and patterns of the L-shaped suspenders 74 are chosen such that a set of the L-shaped suspenders 74 included in an electromagnetic relay can be formed from a single sheet of metal by embossing, cutting, and bending processes. As a matter of fact, the L-shaped suspenders 74 are formed by lead frame technique, in which each pattern of the L-shaped suspenders 74 is interdigitated with each neighbor. Therefore, it is quite easy, to assemble the electromagnetic relay according to the present invention by an automated manufacturing process.

The embodiments are described in detail below. As shown in FIG. 4, the electromagnetic relay according to the present invention has an outer base 5 and outer case (not shown) fixed to the outer base 5 by engagement. The body 6 has an insulating inner base 61 on which both pairs of moving contact springs 62*a*, 62*b* and fixed contact springs 63, 64 are fixed in such an arrangement that a double cross-bar switch is formed. The armatures 66*a*, 66*b* are fixed on fixed ends of the moving contact springs 62*a*, 62*b*, respectively, in order that each of the free ends can be moved between the pair of the fixed contact springs 63, 64 for breaking and making. A pair of electromagnets 67*a*, 67*b* are fixed to the inner base 61 such that extended electromagnet cores 69*a* and 69*b* are opposed to the armature 66*a* and 66*b*, respectively. The moving contact springs 62*a*, 62*b* are monolithic in structure with frames 65*a* and 65*b*, and 65*c* and 65*d*, respectively. When the electromagnets 67*a*, 67*b* are activated by supplying a DC current in the coil 68*a*, 68*b*, each of the extended electromagnetic cores attracts or repels the corresponding armature 66*a*, 66*b* to drive the moving contact springs 62*a*, 62*b*. Needless to say, if the number of moving contact springs increases together with the same number of armatures while the number of the fixed contact springs 63, 64 is maintained unchanged, only the number of contact points on the fixed spring contacts increases. Twin parallel moving spring contacts associated with parallel fixed spring contacts provide a pair of break contacts on one of the fixed spring contacts and another pair of make contacts on the other of the fixed spring contacts under a situation that both electromagnets are not activated. If one of the twin contacts has any contact trouble during operation, the other can perform a normal transfer operation. Therefore, the twin contacts improve reliability of the transfer operation of the electromagnetic relay. The supporting part 7 comprises a plurality of L-shaped suspenders 74 and outer terminals 73 secured to the outer base 5. Each of the outer terminals 73 has a U-shaped spring 71 and an outer terminal lead 72 gaplessly continuous to the U-shaped spring 71. Each of the L-shaped suspenders 74 is supported on the outer base 5 by coupling with the U-shaped spring 71 at the horizontal arm, while the vertical arm of each of the L-shaped suspenders 74 suspends the inner base 61 in perpendicular to the outer base 5, in which all of the components of the body 6 are mechanically connected with the inner base 61. Each of the moving contact springs 62*a*, 62*b*, the fixed contact springs 63, 64 and the coils 68*a*, 68*b* are electrically coupled with the corresponding outer terminals 73 through the L-shaped suspender 74.

Figure 5:
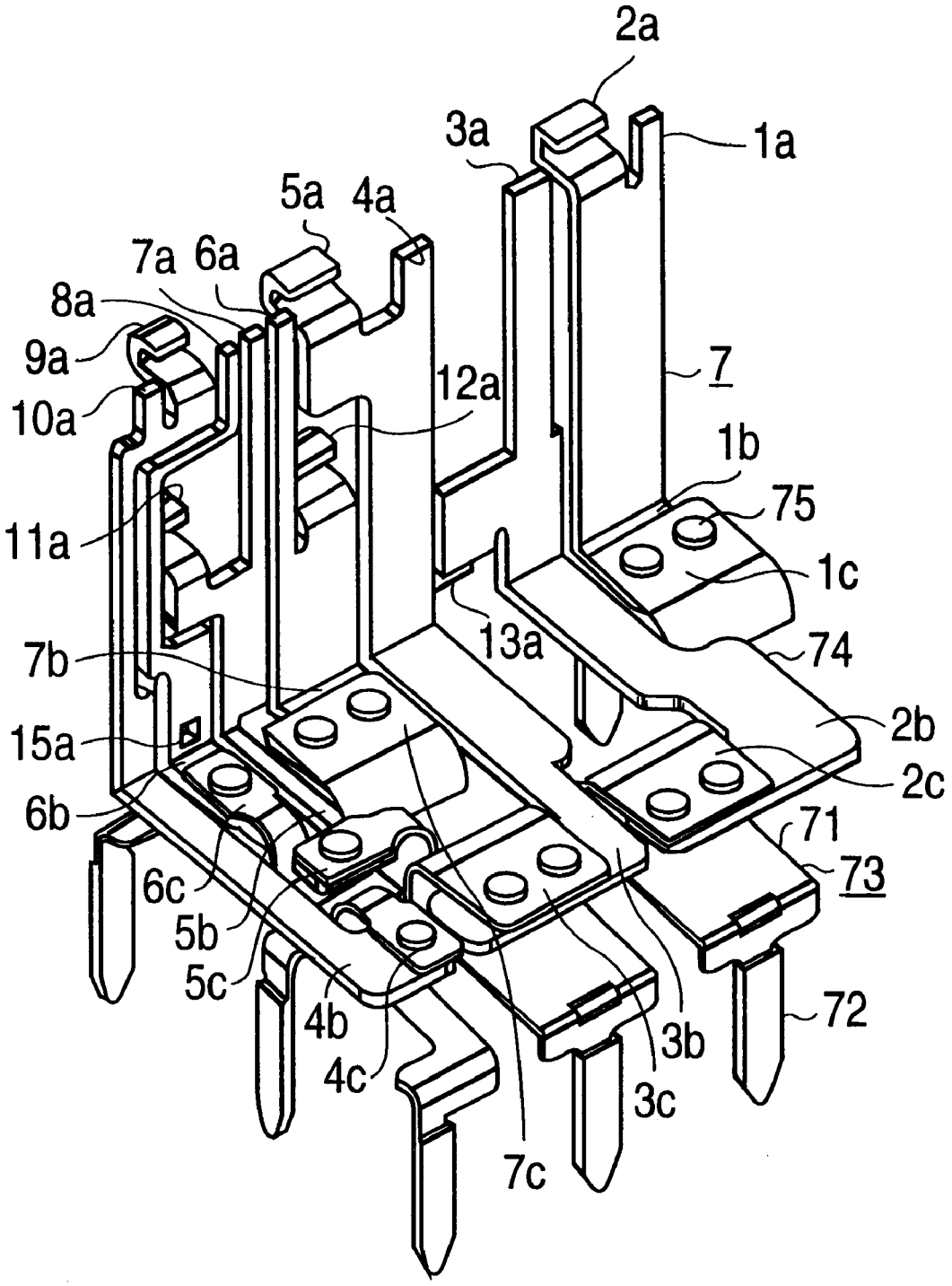
FIG. 5 is a related perspective view of a supporting part of the electromagnetic low noise relay according to the present invention.

FIG. 5 is a rotated perspective view of the supporting part 7 for one embodiment according to the present invention. As described above, the supporting part 7 comprises a plurality of L-shaped suspenders 74 and outer terminals 73 each of which consists of the U-shaped spring 71 and the outer terminal lead 72. The U-shaped spring 71 is gaplessly continuous to the outer terminal lead 72 and has such thickness that the spring characteristics are optimized. Each of the L-shaped suspenders 74 has a boss 75 formed at the horizontal arm by embossing which is inserted into a through hole of the corresponding U-shaped spring 71 and then caulked to unify the L-shaped suspender 74 and the corresponding outer terminal 73 mechanically. As a practical matter, the unification process is carried out one by one between every pair of the L-shaped suspenders 74 and the corresponding U-shaped springs 71 to complete the structure shown in FIG. 5, and then the outer terminal leads 72 are inserted into the respective through holes of the insulating outer base 5. The L-shaped suspender 74 is secured with the inner base 61 of the body 6 at the vertical arm to suspend the body 6 firmly, and that has such a shape that the moving contact springs 62*a*, 62*b*, the fixed contact springs 63, the coils 68*a*, 68*b*, and the outer terminals 73 can be assembled easily. Since a plurality of the L-shaped suspenders 74 parallelly arranged with a predetermined spacing between each other are provided by a lead-frame made originally of a sheet of metal, both unification of the L-shaped suspenders 74 with the outer terminals 73 and combination of the L-shaped suspenders 74 with the body 6 of the electromagnetic relay can be easily carried out by an automated manufacturing process. For instance, as shown in FIG. 5, each of the L-shaped suspenders 74 has a pair of bosses 75 on each of the horizontal arms 1*b*, 2*b*, 3*b*, 7*b* and a single boss 75 on each of the horizontal arms 4*b*, 5*b*, 6*b* formed by embossing. Each of the bosses is inserted into the corresponding through hole on the upper end of the U-shaped springs 1*c*, 2*c*, 3*c*, 4*c*, 5*c*, 6*c*, 7*c* and then caulked to unify the L-shaped suspender 74 and the corresponding outer terminals 73 mechanically.

Figure 6:
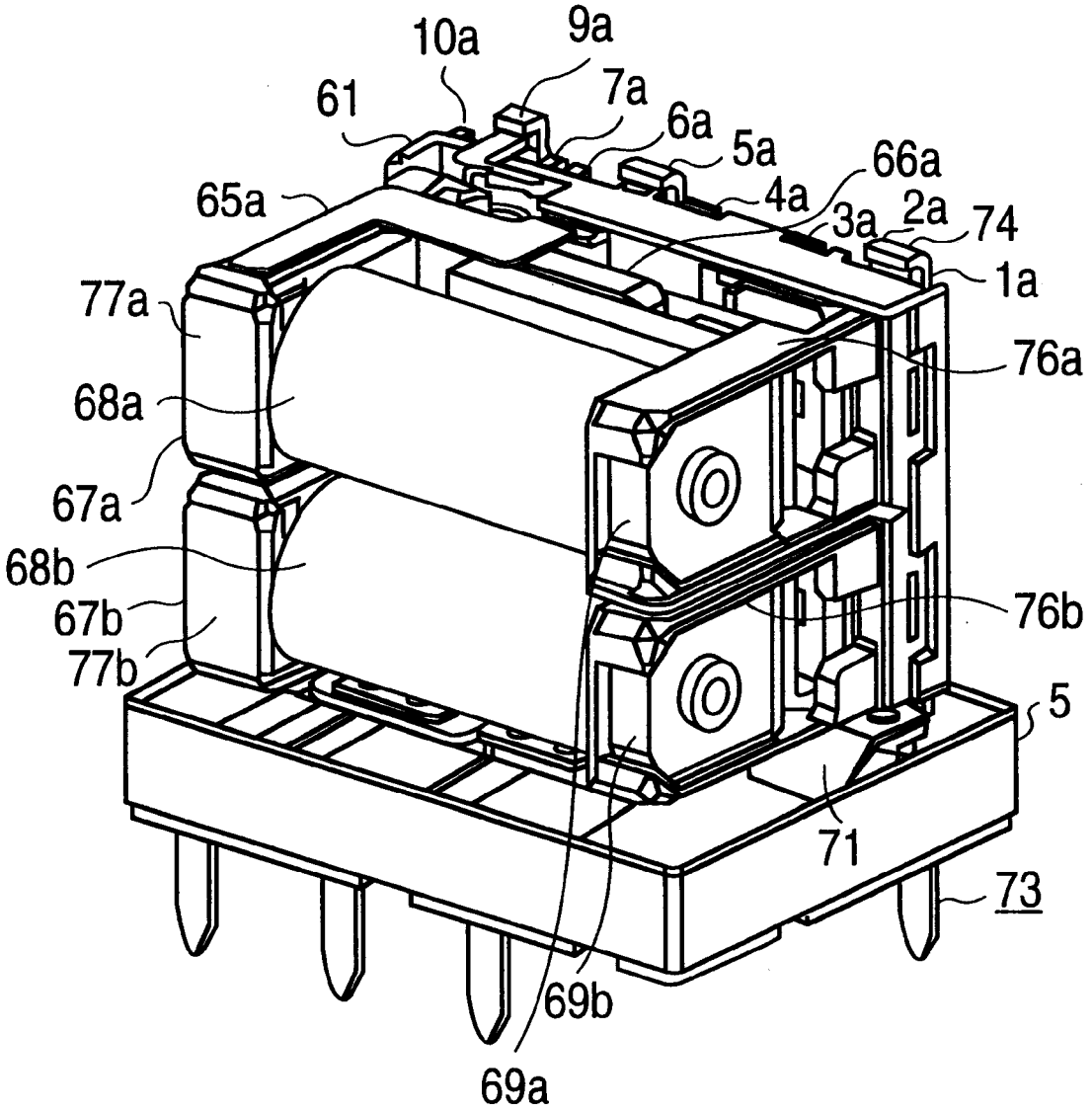
FIG. 6 is a perspective view of the electromagnetic low noise relay without an outer case according to the present invention.

FIG. 6 is a perspective view of the electromagnetic low noise relay without an outer case according to the present invention.

The inner base 61 is suspended by clamping down each of electric terminals of the moving contact springs 62*a*, 62*b*, the fixed contact springs 63, 64 and the coils 68*a*, 68*b* on the reverse side (not shown) of the inner base by plastic deformation of the corresponding crooked end of the vertical arm of the L-shaped suspenders 74. As shown in FIGS. 4 through 6, the crooked ends of the vertical arm of the L-shaped suspenders 2*a* and 13*a*, 5*a* and 12*a*, and 9*a* and 11*a* clamp down the electric terminals of the fixed contact springs 63 and 64, the moving contact springs 62*a*, 62*b*, and the coils 68*a*, 68*b*, respectively. A common electric terminal (not shown) of the coils 68*a*, 68*b* is inserted into a rectangular through hole 15*a* of the vertical arm of the L-shaped suspenders and then caulked to be fixed. A straight end of each vertical arm of the L-shaped suspenders 1*a*, 3*a*, 4*a*, 6*a*, 7*a*, 8*a*, or 10*a* is laid parallelly on the reverse side of the inner base to keep the body stable thereon. As shown in FIG. 6, all parts are assembled with insulating case 76*a* and 77*a*, and 76*b* and 77*b* for each of the coils 68*a* and 68*b*, respectively. The completed electromagnetic relay is encapsulated by a plastic case (not shown).

Thus, the L-shaped suspender 74 unified with the outer terminals 73 is mounted on the insulating box-type outer base 5. Therefore, a structural feature that the inner base 61 of the body 6 is supported by the L-shaped suspender 74 vertically to the outer base 5 enables the armatures 66*a*, 66*b* and the moving contact springs 62*a*, 62*b* to vibrate parallelly to the outer base 5 to eventually apply a horizontal force to the L-shaped suspender 74. Furthermore, since most of the U-shaped springs 71 are aligned to the direction of the vibration, the horizontal displacement of the L-shaped suspender 74 is transformed into a vertical one by changing a radius of curvature of the U-shaped spring. In other words, a noise component conducted through mechanical parts of the relay has been greatly decreased by absorbing the vibrational energy using an effectively long spring. A direct component of the noise propagated by air has been also decreased compared with the second and third conventional relays because the sources of the noise, i.e., the armatures and contacts, are surrounded by the mechanical components as shown in FIG. 6 such that emitted sounds from the sources hit the surfaces of the mechanical components to be absorbed or reflected several times before the sound penetrates the outer plastic case. The noise component absorbed by the mechanical components are damped by the U-shaped spring, and finally dissipated away from the outer terminal leads as thermal energy.

An experimental result on the low acoustic noise electromagnetic relay without a double container according to the present invention showed that the operating sound decreased by 10 db in sound pressure level, and the occupied area and volume were both 25% smaller than those of the conventional relay with a double container having equivalent rated values, respectively. Needless to say, although a pair of electromagnets, armatures, and moving contact springs are described in detail in the foregoing embodiments, the technique can be easily applied to a relay having a single or even more than two electromagnets, armatures, and moving contact springs. Further, only examples using lying U-shaped blade springs for absorbing the horizontal displacement are illustrated in detail, but the essential feature is to select and set a spring such that the direction of the vibration of the armature and moving contact spring should coincide with the direction along which the spring makes the maximum elastic deformation. Therefore, if the direction of the vibration is vertical to the outer base, in addition to the U-shaped spring, a straight blade spring across the outer base or a lying V-shaped blade spring may also be appropriate with respect to both an effective spring characteristic and an occupied space on a printed circuit board. Whatever the shape of the spring is, a total length of the blade spring should be at least longer than a half of the shorter side of the outer base. In the foregoing embodiments, a sheet of metal for the L-shaped suspender 74 is thicker than that of the U-shaped spring 71 because the L-shaped suspender 74 mainly requires rigidity to suspend the body while the U-shaped spring 71 solely requires elasticity. Since both rigidity and elasticity can be largely changed by selecting a shape of the cross section of the L-shaped suspender and, for instance, corrugation can increase bending strength of the L-shaped suspender without increasing width and thickness, the whole supporting part 7 may be provided by a single lead frame in which the L-shaped suspender 74 and the outer terminal 73 are made of a continuous sheet of metal.

What is claimed is:

1. An electromagnetic relay comprising:

a body;

an insulating outer base; and a supporting part connected to said insulating outer base to support said body such that mechanical vibration of said body is insulated from said insulating outer base, wherein said body includes, an insulating inner base, an electromagnet having an iron core secured thereto, a moving contact having a free end, a fixed end secured to said insulating inner base and an armature secured to said moving contact and opposed to the iron core, and a fixed contact secured to said insulating inner base, such that said body makes an on/off action between said moving and fixed contacts by driving the armature by actuating said electromagnet, wherein said supporting part includes a plurality of conducting parts arranged separately from each other, each of said plurality of conducting parts having first and second ends, wherein the first end of at least one of said plurality of conducting parts suspends said insulating inner base such that said insulating inner base and all members secured to said insulating inner base are mechanically insulated from said insulating outer base and the first end of at least another of said plurality of conducting parts suspends said electromagnet such that said electromagnet and any members secured to said electromagnet are mechanically insulated from said insulating outer base, a plurality of elastic conducting parts arranged separately from each other, wherein each of said elastic conducting parts has an upper and a lower end, and the second end of each of said plurality of conducting parts is secured to the corresponding upper end of said plurality of elastic conducting parts, and said insulating outer base has front and back surfaces and a plurality of outer terminal leads secured to said insulating outer base by penetration from the front surface to the back surface, and the lower end of each of said plurality of elastic conducting parts is mechanically and electrically connected to the corresponding one of said plurality of outer terminal leads on the front surface of said insulating outer base.

2. An electromagnetic relay according to claim 1, wherein said insulating inner base is perpendicular to said insulating outer base.

3. An electromagnetic relay according to claim 1, wherein the mechanical vibration of said body has a direction which is parallel to a maximum elastic deformation of said plurality of elastic conducting parts such that an amplitude of the mechanical vibration is damped therein.

4. An electromagnetic relay according to claim 1, wherein each of said plurality of elastic conducting parts is a spring having a first end connected to one of said plurality of outer terminal leads and a second end connected to the second end of the corresponding conducting part.

5. An electromagnetic relay according to claim 1, wherein the armature moves in parallel to said insulating outer base in a transfer operation.

6. An electromagnetic relay according to claim 1, wherein an area between the armature and the iron core and between said moving contact and said fixed contact is surrounded by said insulating inner base and said electromagnet.

7. An electromagnetic relay according to claim 1, wherein each of said plurality of conducting parts, said plurality of elastic conducting parts, and said plurality of outer terminal leads connected in series forms a current path electrically connected to the corresponding one of said electromagnet, moving contact, and fixed contact.

8. An electromagnetic relay according to claim 4, wherein said spring is gaplessly continuous to said plurality of outer terminal leads.

9. An electromagnetic relay according to claim 4, wherein said spring is one of a U, V, or straight shaped blade spring.

10. An electromagnetic relay comprising:

a body including an insulating inner base, an electromagnet having an iron core, a moving spring contact having an armature on a fixed end opposed to the iron core, and a pair of fixed spring contacts to make an on/off action between the moving and fixed spring contacts by attracting the armature to the iron core or repelling the armature from the iron core by actuating the electromagnet, wherein each of the electromagnet, moving spring contact, and the pair of fixed spring contacts is supported by the insulating inner base;

a plurality of insulated conducting L shaped suspenders each of which has a vertical arm and a horizontal arm to support the body by connecting the vertical arm of each of the insulated conducting L shaped suspenders with the insulating inner base:

a plurality of U shaped blade springs to support the insulated conducting L shaped suspenders by connecting a first end of each of the U shaped blade springs with the horizontal arm of the corresponding one of the insulated conducting L shaped suspenders;

a plurality of outer terminal leads, each of which is connected to a second end of each of the U shaped blade springs to supply an electric current to the corresponding one of the electromagnet, moving spring contact, and pair of fixed spring contacts through each of the insulated conducting L shaped suspenders and the U shaped blade springs connected in series; and an insulating outer base penetrated by the outer terminal leads from a front surface to a back surface for supporting the body above the front surface of the insulating outer base by each of the insulated conducting L shaped suspenders, the U shaped blade springs, and the outer terminal leads in series connection.

11. An electromagnetic relay according to claim 10, wherein the insulating inner base supports plural sets of the electromagnet with the iron core and the moving spring contact with the armature.

12. An electromagnetic relay according to claim 10, wherein each of the insulated conducting L shaped suspenders is made of a sheet of metal.

13. An electromagnetic relay according to claim 10, wherein when the insulated conducting L shaped suspenders are developed on a plane by straightening bending parts, the developed insulated conducting L shaped suspenders have a pattern between a plurality of neighbors such that the insulated conducting L shaped suspenders can be formed using a single sheet of metal by a lead frame technique.

14. An electromagnetic relay according to claim 10, wherein the iron core is extended in a direction parallel to an axis of the electromagnet such that the electromagnet and the iron core are arranged side by side.

15. An electromagnetic relay according to claim 10, wherein the moving spring contact is arranged in a direction perpendicular to the pair of fixed spring contacts to form a pair of cross bar switches.

16. An electromagnetic relay according to claim 10, wherein each of the insulated conducting L shaped suspenders and the corresponding one of the U shaped blade springs are gaplessly continuous to each other and are made of a sheet of metal.

17. An electromagnetic relay according to claim 10, wherein each of the U shaped blade springs is aligned to a direction of vibration caused by the on/off action of the electromagnetic relay such that a horizontal displacement of each of the insulated conducting L shaped suspenders by the vibration is transformed into a vertical displacement by changing a radius of curvature of each of the U-shaped springs.

18. An electromagnetic relay according to claim 10, wherein the second end of each of the U shaped blade springs is gaplessly continuous to the corresponding one of the outer terminal leads.

19. An electromagnetic relay according to claim 10, wherein a free end of the moving spring contact is positioned between the pair of fixed spring contacts.

20. An electromagnetic relay according to claim 10, wherein the vertical arm of each of the insulated L shaped suspenders is parallel to the inner base and the horizontal arm of each of the insulated L shaped suspenders is parallel to the outer base.

* * * * *